US006367792B1

(12) United States Patent
Chagnon

(10) Patent No.: US 6,367,792 B1
(45) Date of Patent: Apr. 9, 2002

(54) COPY-GUIDING CYLINDER OF A FOLDER

(75) Inventor: Franck Chagnon, S'Lev d'Esserent (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/633,730

(22) Filed: Aug. 7, 2000

(30) Foreign Application Priority Data

Aug. 5, 1999 (DE) ..... 199 36 842
May 18, 2000 (FR) ..... 00 06352

(51) Int. Cl.[7] ..... B41F 13/58

(52) U.S. Cl. ..... 270/5.02; 270/6; 270/8; 270/42; 493/424

(58) Field of Search ..... 270/5.02, 6, 8, 270/21.1, 42, 45, 47, 49, 50; 493/424, 428, 429, 440

(56) References Cited

U.S. PATENT DOCUMENTS 3,477,709 A * 11/1969 Neal et al. ..... 493/424
4,190,242 A * 2/1980 Bolza-Schünemann ..... 270/50
4,279,410 A * 7/1981 Bolza-Schünemann ..... 270/6
4,564,183 A * 1/1986 Müller ..... 270/21.1
5,039,076 A 8/1991 Fischer
5,072,919 A * 12/1991 Schneider et al. ..... 270/21.1
5,386,979 A * 2/1995 Müller ..... 270/21.1
5,405,126 A * 4/1995 Mack ..... 270/6
5,405,127 A * 4/1995 Welborn ..... 270/21.1
5,429,578 A 7/1995 Calbrix et al.
5,439,206 A * 8/1995 Raasch et al. ..... 270/21.1
5,494,270 A * 2/1996 Laubscher ..... 270/49
5,520,378 A * 5/1996 Kepert et al. ..... 270/8
5,527,256 A * 6/1996 Vauchelle ..... 270/6
5,653,429 A * 8/1997 Michalik ..... 270/8

FOREIGN PATENT DOCUMENTS

DE 38 31 182 C2 8/1990
DE 44 26 987 A1 2/1996
DE 44 26 987 C2 10/1998

* cited by examiner

*Primary Examiner*—Eugene Eickholt
(74) *Attorney, Agent, or Firm*—Herbert L. Lerner; Laurence A. Greenberg; Werner H. Stemer

(57) ABSTRACT

In a rotary printing machine, a folder operatable in different folding modes, and having a copy-guiding cylinder to which copies severed from a material web by a cutting-cylinder pair are feedable, the copy-guiding cylinder having a circumferential surface wherein gripping and cross-folding elements are accommodated, includes a device having movable circumferential-surface parts guidable by a respective guide element and, during folding-mode changeovers, selectively extendable into the circumferential surface of the cylinder and retractable between stationary and movable segments of the copy-guiding cylinder which are positionable relative to one another.

17 Claims, 4 Drawing Sheets

25
12
14
35
A
29
39
40
44
30
11
36
38
37
41
42
10
13
32
9
A'
29'
31
34
33

COPY-GUIDING CYLINDER OF A FOLDER

BACKGROUND OF THE INVENTION

FIELD OF THE INVENTION

The invention relates to a copy-guiding cylinder of a folder, which is operatable in different folding modes, and is disposed downline of a rotary printing machine.

The published German Patent Document DE 44 26 987 C2, which is exemplary of the prior art, discloses a folder with format changeover. The folder is equipped with at least two folding cylinders which are located downline of a cutting cylinder and of which at least one has at least two cylinder bodies which are mounted on a shaft, are positioned inside one another and, during standstill or operation, are adjustable relative to one another by a planetary-gear transmission. The first cylinder body cooperates with a cutting cylinder, while the second cylinder body cooperates with the at least one cylinder body of the second folding cylinder, it being possible for the second cylinder body to be adjusted together with the at least one cylinder body of the second folding cylinder.

The first cylinder body and the second cylinder body of the first folding cylinder are connected to one another via a first planetary-gear transmission and a second planetary-gear transmission, one shaft being common to both transmissions. The planetary gears of the first planetary-gear transmission are arranged rotatably on a driven gearwheel which drives the first cylinder body. The planetary gears drive a sun gear which is common to the two planetary-gear transmissions. The sun gear drives the second cylinder body via planetary gears of the second planetary-gear transmission, the two planetary-gear transmissions, in conjunction with one another, having a transmission ratio of 1:1.

The foregoing proposed construction involves a great mechanical outlay.

The French Patent 2 697 205 is concerned with a folder for processing continuous printed material webs. The folder described therein is equipped with a cutting device cooperating with a transfer cylinder that is driven about the axis thereof. The transfer cylinder, which is equipped with an interrupted circumferential surface, cooperates with a folding jaw cylinder having folding jaws on the circumference thereof, and sets of pins and folding blades are provided, which serve for transversely inserting copies severed from the material web into the folding jaws. Also provided on the transfer cylinder are devices by which relative displacement between pins and folding blades can take place. Closure plates are accommodated on the circumference of the transfer cylinder on both sides of the folding blades and, likewise, on both sides of the sets of pins. The two closure plates can be moved relative to one another in the manner of a coulisse or sliding block, the plates forming a virtually continuous outer lateral surface of the cylinder, regardless of the respective angular position of the folding blades and the sets of pins relative to one another on the circumference.

A disadvantage with this construction was that the curvature of the closure plates was difficult to produce and the coulisse-type guidance of the closing plates within one another inevitably resulted in a stepped lateral surface of the cylinder, although the step was relatively small. This results in different circumferential speeds for the copies on the circumference of a cylinder formed in this manner.

SUMMARY OF THE INVENTION

As a further development of the foregoing constructions of the prior art, the invention of the instant application has, as objects thereof, maintaining the cylindricity of a product-guiding folding cylinder that is adjustable in accordance with the then operating folding mode, and achieving a constant circumferential speed of the copies guided on the circumference of the cylinder.

With the foregoing and other objects in view, there is provided, in accordance with one aspect of the invention, in a rotary printing machine, a folder operatable in different folding modes, and having a copy-guiding cylinder to which copies severed from a material web by a cutting-cylinder pair are feedable, the copy-guiding cylinder having a circumferential surface wherein gripping and cross-folding elements are accommodated, comprising a device including movable circumferential-surface parts guidable by a respective guide element and, during folding-mode changeovers, selectively extendable into the circumferential surface of the cylinder and retractable between stationary and movable segments of the copy-guiding cylinder which are positionable relative to one another.

In accordance with another feature of the invention, the circumferential-surface parts are pivotable about a pin carried by one of the segments of the cylinder.

In accordance with a further feature of the invention, the pin is carried by a stationary segment of the cylinder.

In accordance with an added feature of the invention, the respective guide element of the circumferential-surface parts is connected to one of the segments of the cylinder.

In accordance with an additional feature of the invention, the respective guide element is accommodated on a movable segment of the cylinder.

In accordance with yet another feature of the invention, the device includes a prestressing unit for subjecting the circumferential-surface parts to torsion, at respective mounting locations thereof.

In accordance with yet a further feature of the invention, the circumferential-surface parts are provided with a follower element guidable in the guide element.

In accordance with yet an added feature of the invention, the follower element is formed as a roller.

In accordance with yet an additional feature of the invention, the guide element has a cage bounded by two runner surfaces.

In accordance with still another feature of the invention, the runner surfaces merge into an upper and a lower cutout formed in the guide element.

In accordance with still a further feature of the invention, the device includes a toggle-lever system for supporting the movable circumferential-surface parts.

In accordance with still an added feature of the invention, the toggle-lever system includes a lever rotatably mounted on the stationary segment.

In accordance with still an additional feature of the invention, the device includes a stop formed between upper and lower levers of the toggle-lever system in vicinity of a toggle joint thereof.

In accordance with another feature of the invention, the device includes a prestressing element actable upon the toggle-lever system.

In accordance with a further feature of the invention, the segments of the cylinder have a spacing formed therebetween for allowing overfold corrections.

In accordance with an added feature of the invention, the folder in the rotary printing machine is pinless.

In accordance with a concomitant aspect of the invention, there is provided a copy-guiding cylinder for a folder of a rotary printing machine, the folder being operatable in different folding modes, the cylinder having copies severed from a material web by a cutting-cylinder pair feedable thereto, and having a circumferential surface wherein gripping and cross-folding elements are accommodated, comprising movable circumferential-surface parts guidable by a respective guide element and, during folding-mode changeovers, selectively extendable into the circumferential surface of the cylinder and retractable between stationary and movable segments of the cylinder which are positionable relative to one another.

The solution for the problems found in the prior art, which are realized in the invention of the instant application is accompanied by a large number of advantages. On the one hand, retraction and extension of the circumferential-surface parts take place automatically during folding-mode changeovers due to the positive guidance of the circumferential-surface parts. On the other hand, a precisely achievable cylindricity of the circumferential surface of the copy-guiding cylinder is assured by mounting the circumferential-surface parts on one of the segments of the copy-guiding cylinder. The circumferential-surface parts, which are retracted or extended with positive guidance during folding-mode changeovers, are adapted or matched with respect to curvature to the lateral surface of the cylinder, with the result that different speeds are not imposed upon copies guided on the lateral surface of the copy-guiding cylinder according to the invention.

In an advantageous development of the idea upon which the invention is based, the circumferential-surface parts can be pivoted about a pin on one of the segments of the copy-guiding cylinder. The movable circumferential-surface parts are preferably mounted on the stationary segment, while the guide elements guiding the circumferential-surface parts in accordance with a selection of the folding mode are preferably accommodated on the movable segment of the copy-guiding cylinder.

In order to allow the circumferential-surface parts to pivot about the mounting thereof with as little play as possible, the mountings of the circumferential-surface parts are provided with a prestressing unit which imposes a torsional moment thereon. The circumferential-surface parts themselves are provided with a follower element which is guided in the guide element and, depending upon the folding-mode changeover, produces a retraction or extension movement of the circumferential-surface part. The follower element may be rotatably formed on the circumferential-surface part, for example, as a runner roller or as a bearer ring. In order to achieve a precisely operating construction with as long a service life as possible, cages which enclose the follower elements and are bounded by two curved runner surfaces are formed on the guide element. The runner surfaces, respectively, merge at the upper and lower ends thereof, respectively, into an upper and a lower cutout or recess formed in the guide element. In the upper and lower cutouts of the guide element, the follower elements can be displaced in the circumferential direction so that it is possible to make overfold adaptations or adjustments of between 1 and 5 mm on the copy which is to be folded, without any retraction by a circumferential-surface part between the segments of the copy-guiding cylinder during the overfold-adaptation or adjustment operations.

The circumferential-surface parts are advantageously supported by a toggle-lever system. One of the levers of the toggle-lever system is mounted rotatably on the stationary segment of the copy-guiding cylinder. At the toggle joint thereof, the connecting location between the upper and the lower levers, the toggle-lever system is subjected to the action of a prestressing element, which avoids play and thus produces precise guidance of the mechanical components of the toggle-lever system. A stop may advantageously be formed on one of the levers of the toggle-lever system, the stop precisely defining the extended position of the circumferential-surface part and thus ensuring that the precise cylindricity of the circumferential surface of the copy-guiding cylinder is maintained when the circumferential-surface parts are extended.

Provided between the segments of the copy-guiding cylinder are spacings which, together with the upper and the lower cutouts provided in the guide elements, allow adaptation or adjustment of the overfold both in the double parallel-fold folding mode and in the delta-fold folding mode.

The copy-guiding cylinders may advantageously be used both in folders having sets of pins and in folders which operate without pins.

Other features which are considered as characteristic for the invention are set forth in the appended claims.

Although the invention is illustrated and described herein as embodied in a copy-guiding cylinder of a folder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
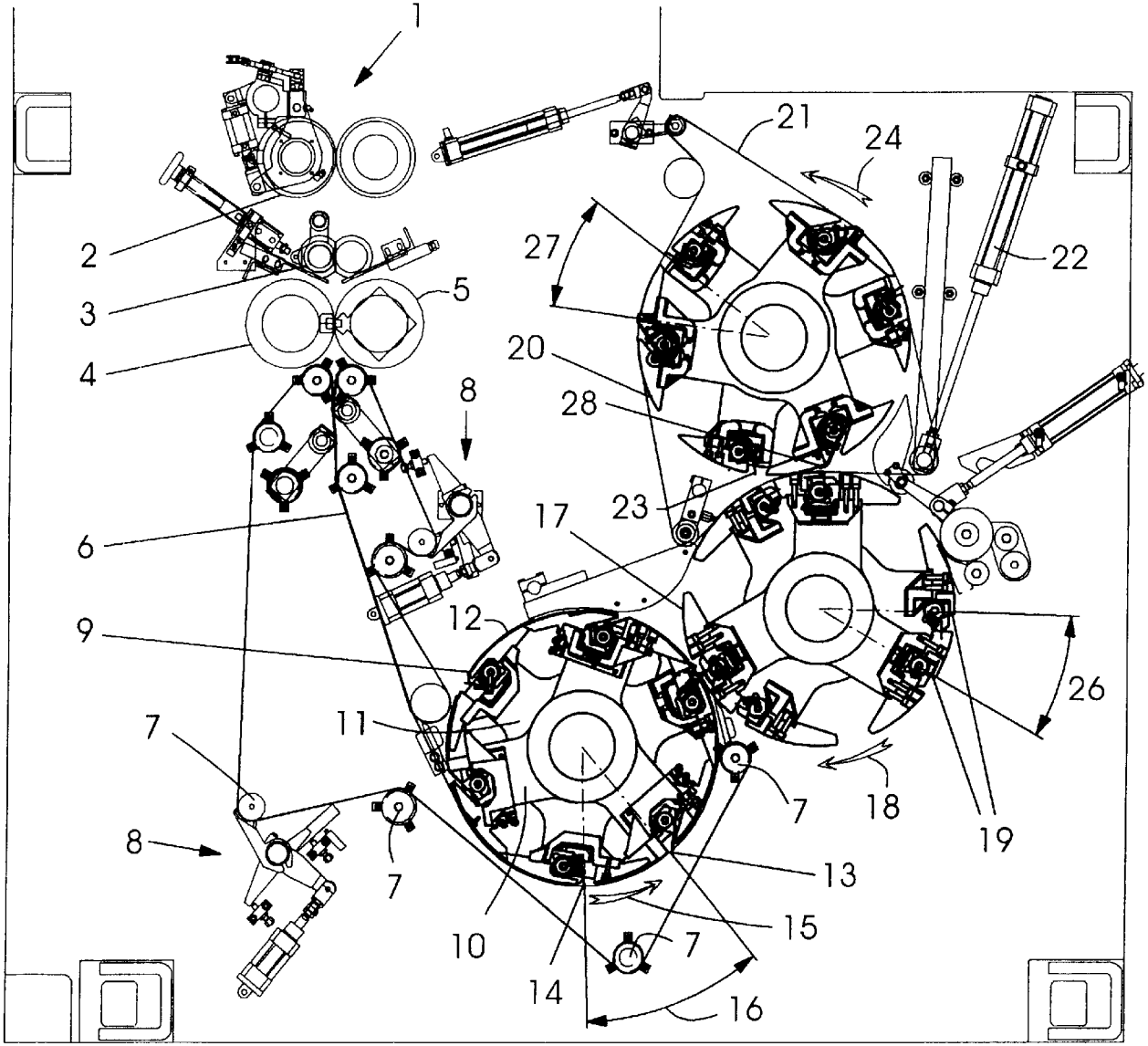
FIG. 1 is a diagrammatic front elevational view of a folder adjusted to a delta-fold folding mode.

Referring now to the drawings and, first, particularly to FIG. 1, thereof, there is shown therein a folder configuration wherein a folder can be operated in the delta-fold folding mode.

A multi-layered, printed material web provided, if necessary or desirable, with a first longitudinal fold runs from above along a path 1 thereof into a folder. Via a first draw-in roller pair 2, the material web passes through a perforating nip which is located between two cooperating pleating or perforating cylinders 3. After the material web has been perforated or pleated, copies are severed from the material web in a cutting nip between a cutting cylinder 4 and a groove cylinder 5. The copies pass into accelerating transport belts 6 beneath the cutting nip and are transported by the belts 6 to a circumferential surface 12 of a copy-guiding cylinder 9. The mutually cooperating accelerating belts 6 run around revolving rollers 7 and are subjected to stress or stress-relieved by suitable stressing and stress-relieving devices 8, respectively, for example when the belts are exchanged after relatively long operating times, or if the belts are impermissibly lengthened.

The copy-guiding cylinder 9 includes a stationary segment 10 and a segment 11 that is movable relative thereto; in this regard, for example, grippers 13 are accommodated on the stationary segment 10, while folding blades 14 for executing a first cross-cut are accommodated on the moveable segment 11. Because this first cross-fold is located in different positions on the copy which is to be folded depending upon whether delta folding or double parallel folding is used, an adaptation, in accordance with the selected folding mode, of the position of the first cross-folding blade 14 to the copy which is to be folded is necessary. The copy-guiding cylinder 9 rotates in the direction of rotation represented by the arrow 15, the belt lengths 6 which are necessary, in pin-free folders, for guiding the copies on the circumference 12 of the cylinder 9 extending to a nip formed with a jaw cylinder 17.

The copy length 16, in the delta-fold folding mode, extends between the leading edge of the copy being gripped by the grippers 13, and the position of the first cross-folding blade 14 relative to the copy. In the double parallel-fold folding mode, the corresponding length 25 is greater (note FIG. 2). The jaw cylinder 17, which cooperates with the copy-guiding cylinder 9, likewise includes an otherwise non-illustrated stationary segment and a segment that is movable relative thereto, the segments, respectively, accommodating a set of folding jaws 19 and rotating in a direction of rotation represented by the arrow 18 as shown.

A respective quarter copy length 26 is located between the folding jaws 19 of the stationary and movable segments, and applies, as well, to the second cross-folding cylinder 20 which, in the illustrated exemplary embodiment, is mounted above the jaw cylinder 17. Accommodated alongside copy grippers 28, on the circumferential surface of the second cross-folding cylinder 20, are folding blades 23 for the second cross-fold on the copy, grippers 28 and folding blades 23 on the lateral surface of the second cross-folding cylinder 20 likewise being spaced apart from one another by about a quarter copy length 27. The circumference of the second cross-folding cylinder 20 is enclosed by a further belt length 21 to which stressing devices 22 are assigned, by the aid of which the copies gripped at the folding spine thereof in the folding jaws 19 of the jaw cylinder 17 are pressed against the circumferential surface of the jaw cylinder 17.

Figure 2:
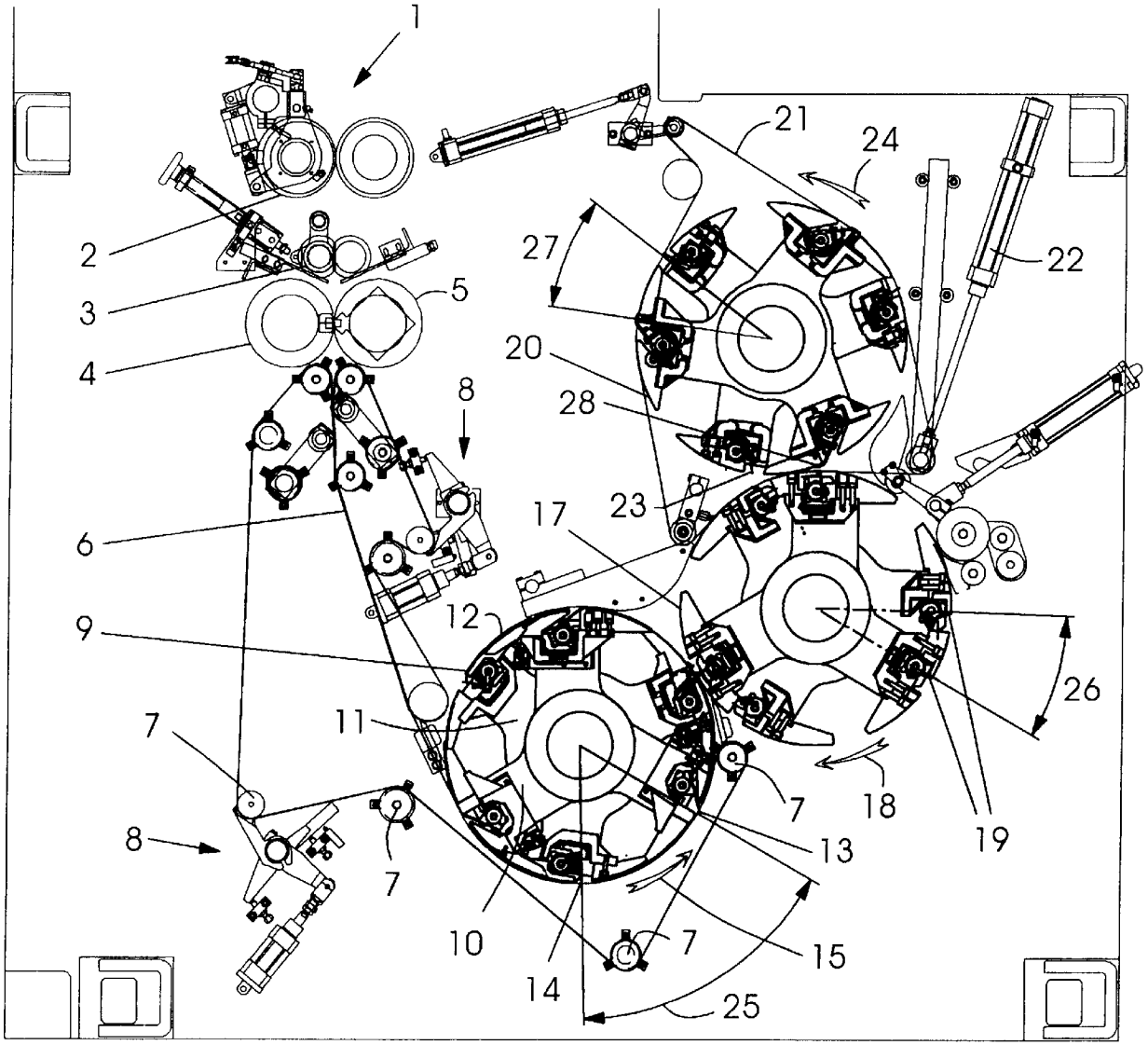
FIG. 2 is a view like that of FIG. 1 of the folder operating in a double parallel-fold folding mode.

FIG. 2 shows an embodiment of a folder that is operated in the double parallel-fold folding mode. In contrast with the configuration illustrated in FIG. 1, the stationary segment 10 and movable segment 11 of the copy-guiding cylinder 9 of FIG. 2 have been adjusted further relative to one another, with the result that half a copy length is located between the copy grippers 13 and the folding blade 14 for the first cross-fold. The half-copy length is identified as 25 in FIG. 2 and corresponds to a circumferential angle of approximately 75.65°. In a manner analogous to FIG. 1, the copies are transported to the circumferential surface 12 of the copy-guiding cylinder 9, gripped by grippers 13 thereat and positioned to half the copy length 25 by the folding blades 14 for the first cross-fold and, in the nip between the copy-guiding cylinder 9 and the opposing jaw cylinder 17, pushed into correspondingly positioned folding jaws 19 of the jaw cylinder 17. The first cross-fold, whether it is a delta fold to ⅓ of the product length 16 as shown in FIG. 1, or the first double parallel fold as illustrated in FIG. 2, is thus formed on the jaw cylinder 17. By the folding blades 23 for the second cross-fold, the blades 23 being accommodated on the second cross-folding cylinder 20, either the second parallel fold, i.e., the double parallel fold, can be completed on the copy, or the delta fold can be formed.

Figure 3:
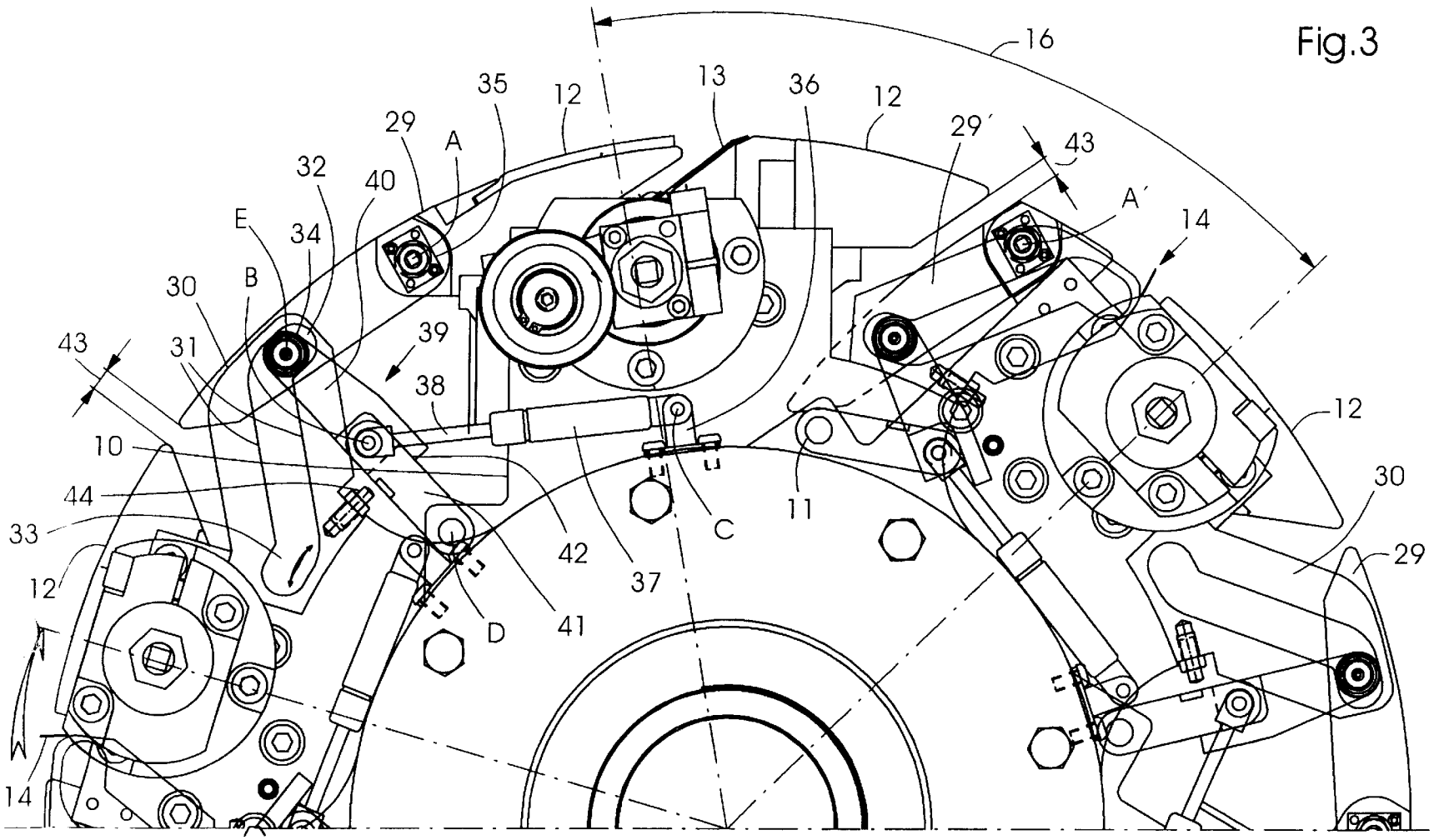
FIG. 3 is an enlarged fragmentary view of FIG. 1 showing a folding copy-guiding cylinder of the folder in the delta-fold folding mode.

FIG. 3 shows a copy-guiding cylinder according to the invention in the delta-fold folding mode. In this configuration, one circumferential-surface part 29, which is mounted on a stationary segment 10, is illustrated in the extended position, while a further circumferential-surface part 29' has been retracted into the interior of the copy-guiding cylinder 9. Accordingly, in the delta-fold folding mode, the movable circumferential-surface parts 29 assigned to the grippers 13 have been extended into the lateral surface 12, while those circumferential-surface parts 29' which are assigned to the folding blades 14 remain retracted therein. The extended circumferential-surface part 29 is accommodated on a pin A of the stationary segment 10. Located on the pin A is a prestressing element 35 which imposes a torsional moment on the circumferential-surface part 29. Mounted on the circumferential-surface part 29 is a follower element 34 which is in the form of a roller or a bearing ring that engages in a guide element 30 mounted on the movable segment 11 of the copy-guiding cylinder 9. The guide element 30 illustrated herein has a cage for the roller 34, the cage being bounded by two runner surfaces 31 and merging into an upper and a lower cutout or recess 32 and 33, respectively, of the guide element 30.

The cutouts 32 and 33 formed in the guide element 30 allow movements of the stationary and movable segments 10 and 11, respectively, relative to one another when the circumferential-surface parts 29 and 29' are located either in the fully retracted position or in the fully extended position. These relative movements may be necessary if the overfold which is to be set on the copy has to be matched or adjusted. Spacings 43 between the stationary and the movable segments 10 and 11, respectively, allow movements in the circumferential direction of from 1 to 10 mm, so that the length of the overfold can be varied.

The circumferential-surface parts 29 are supported by a toggle-lever system 39 which includes an upper lever 40 and a lower lever 41. The upper lever 40 accommodates the roller 34, which rotates about the pin E; the lower lever 41 is mounted so as to be rotatable about the pin D in the hub region of the copy-guiding cylinder 9. Articulated in the toggle joint, the pin B, is a prestressing element 37 which eliminates play from the toggle-lever system 39 and presses the circumferential-surface part 29 into the exact position thereof for maintaining the cylindricity of the lateral surface in accordance with the curvature thereof. The prestressing element 37, for its part, is accommodated in a bearing block 36 so as to be rotatable about the pin C, it being possible for the bearing block to be connected to the hub of the copy-guiding cylinder 9.

While the circumferential-surface part 29 is in the extended position thereof, the circumferential-surface part 29' is illustrated in the retracted position thereof. The circumferential-surface part 29' is located downline from the folding blade 14 for the first cross-fold, and projects, in accordance with the contour thereof shown in broken lines, into the interior of the copy-guiding cylinder 9. The follower element 34 thereof is located in the lower cutout 33 of the guide element 30, and the toggle-lever system 39 is illustrated in the buckled or inflected position thereof, the circumferential-surface part 29', which is not required here, having been moved into the inactive position thereof. Illustrated between the surface of the inactive circumferential-surface part 29' and the lateral-surface part 12 of the stationary segment 10, the lateral-surface part 12 being located in front of the circumferential-surface part 29', as viewed in FIG. 3, is a spacing 43 which allows adjustment of the overfold on the copy, as has been described hereinbefore. A third of the product length 16 extends between the center of the mounting of the folding blade 14 for the first cross-fold and the center of the mounting of the gripper 13, the product length 16 corresponding to an angle of 56.44° of the circumference of the copy-guiding cylinder 9.

Figure 4:
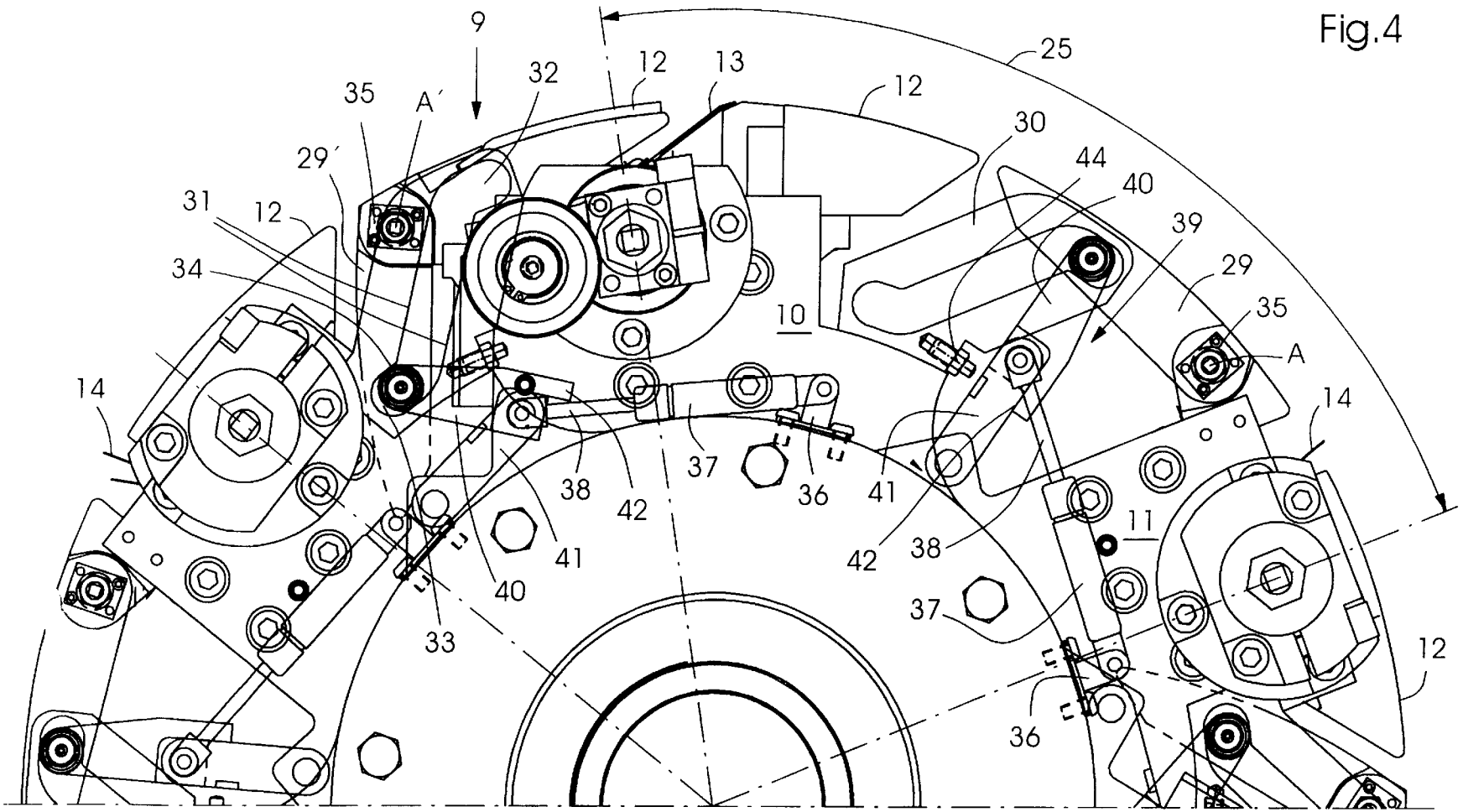
FIG. 4 is an enlarged fragmentary view of FIG. 2 showing the copy-guiding cylinder with segments thereof positioned relative to one another in the double parallel-fold folding mode.

FIG. 4 shows the position of the components in a copy-guiding cylinder 9 according to the invention which is in the double parallel-fold folding mode. In this folding mode, the circumferential-surface part 29, which is illustrated in FIG. 3 as still being extended into the lateral surface 12 of the copy-guiding cylinder 9, assumes an inactive position 29', while the circumferential-surface part 29', which is illustrated in FIG. 3 as retracted into the interior of the copy-guiding cylinder 9, has been retracted into the lateral surface 12 of the copy-guiding cylinder 9. The follower element 34, accommodated between the two runner surfaces 31 of the guide element 30, is located in the lower cutout 33 thereof; the upper cutout 32 of the guide element 30 is empty. The two levers 40 and 41 of the toggle-lever system 39 have been transferred, counter to the prestressing by the prestressing element 37, from the outstretched position thereof according to FIG. 3 into the inflected or buckled position thereof. Accordingly, the actuating rod 38 has been partly retracted into the prestressing element 37 which, for its part, is accommodated rotatably on the bearing block 36 in the hub region of the copy-guiding cylinder 9. It is believed to be apparent from the view according to FIG. 4 that the follower elements 34 of the circumferential-surface parts 29 and 29' can yet move from ±1 to 10 mm in the circumferential direction both in the upper and in the lower cutouts 32 and 33, respectively, in order to permit adjustment at the overfold. The cutouts 32 and 33, respectively, allow angular offsets of up to 2° in the circumferential direction, which allows an overfold offset of ±1 to 10 mm on the copy.

Use of the aforedescribed copy-guiding cylinder 9 according to the invention is possible both in conventional folders and in folders which operate without pins, both for newspaper printing and for jobbing applications. Collecting cylinders or folding jaw cylinders or further copy-guiding cylinders in folders, such as grippers and transport cylinders, can be analogously adjusted and operated in a manner dependent upon the folding mode.

I claim:

1. In a rotary printing machine, a folder operatable in different folding modes, and having a copy-guiding cylinder to which copies severed from a material web by a cutting-cylinder pair are feedable, the copy-guiding cylinder having a circumferential surface wherein gripping and cross-folding elements are accommodated, comprising a device including movable circumferential-surface parts guidable by a respective guide element and, during folding-mode changeovers, selectively extendable into the circumferential surface of the cylinder and retractable between stationary and movable segments of the copy-guiding cylinder which are positionable relative to one another.

2. The device according to claim 1, wherein said circumferential-surface parts are pivotable about a pin carried by one of said segments of the cylinder.

3. The device according to claim 2, wherein said pin is carried by a stationary segment of the cylinder.

4. The device according to claim 1, wherein the respective guide element of said circumferential-surface parts is connected to one of said segments of the cylinder.

5. The device according to claim 4, wherein the respective guide element is accommodated on a movable segment of the cylinder.

6. The device according to claim 1, including a prestressing unit for subjecting said circumferential-surface parts to torsion, at respective mounting locations thereof.

7. The device according to claim 1, wherein said circumferential-surface parts are provided with a follower element guidable in said guide element.

8. The device according to claim 7, wherein said follower element is formed as a roller.

9. The device according to claim 1, wherein said guide element has a cage bounded by two runner surfaces.

10. The device according to claim 9, wherein said runner surfaces merge into an upper and a lower cutout formed in said guide element.

11. The device according to claim 1, including a toggle-lever system for supporting said movable circumferential-surface parts.

12. The device according to claim 11, wherein said toggle-lever system includes a lever rotatably mounted on said stationary segment.

13. The device according to claim 11, including a stop formed between upper and lower levers of said toggle-lever system in vicinity of a toggle joint thereof.

14. The device according to claim 11, including a prestressing element actable upon said toggle-lever system.

15. The device according to claim 1, wherein said segments of the cylinder have a spacing formed therebetween for allowing overfold corrections.

16. The device according to claim 1, wherein the folder is pinless.

17. A copy-guiding cylinder for a folder of a rotary printing machine, the folder being operatable in different folding modes, the cylinder having copies severed from a material web by a cutting-cylinder pair feedable thereto, and having a circumferential surface wherein gripping and cross-folding elements are accommodated, comprising movable circumferential-surface parts guidable by a respective guide element and, during folding-mode changeovers, selectively extendable into the circumferential surface of the cylinder and retractable between stationary and movable segments of the cylinder which are positionable relative to one another.

* * * * *